United States Patent [19]

Heimlicher

[11] 3,934,508

[45] Jan. 27, 1976

[54] METHOD AND APPARATUS FOR ADJUSTING ROLLERS IN A PRINTING PRESS

[75] Inventor: Paul Heimlicher, Bolligen, Switzerland

[73] Assignee: Maschinenfabrik Wifag, Switzerland

[22] Filed: Feb. 11, 1974

[21] Appl. No.: 441,442

[30] Foreign Application Priority Data

Feb. 14, 1973 Sweden ..... 7302098

[52] U.S. Cl. ..... 101/349; 101/426

[51] Int. Cl.[2] ..... B41F 31/10

[58] Field of Search ..... 101/348, 349–352, 101/148, 426

[56] References Cited

UNITED STATES PATENTS

| | | | |
|---|---|---|---|
| 2,539,383 | 1/1951 | Davidson | 101/352 |
| 3,107,608 | 10/1963 | Ward | 101/352 |
| 3,183,045 | 5/1965 | Hegeman | 101/348 X |
| 3,538,849 | 11/1970 | Bohman | 101/352 |

*Primary Examiner*—J. Reed Fisher

*Attorney, Agent, or Firm*—Toren, McGeady and Stanger

[57] ABSTRACT

In a printing press including a first roller which is rotatable about a stationary axis and an adjustably positionable second roller spaced from the first roller, a third roller is adjustably positionable into contact with the first and second rollers initially by positioning it in contact with the first roller and fixing the relative positions of the two rollers and then by placing the third roller into contact with the second roller while maintaining the fixed relationship between the first and third rollers.

7 Claims, 5 Drawing Figures

4
2
1
3
2
b
15a
18
13
15
16
14
12
20
8
7
15b
19
17
9
a
11a
6
11
10
5

4
2
2
b
15a
18
15
c
26
27
14
28
12
15b
7
25
24
21
22
21a
17
23
9
a
6
11a
10
11
5

4
2
2
b
18
15a
15
14
32
12
24
8
7
21
22
21a
23
17
a
d
6
11a
33
30
9
31
11
29
5

2
2
d
18
15a
7
32
e
22
21
12
23
21a
33
17
11a
6
f
30
9
31
11
29
5

2
2
g2
18
15a
e
32
21
22
7
12
23
11a
21a
17
6
33
d
30
31
11
9
29
5

METHOD AND APPARATUS FOR ADJUSTING ROLLERS IN A PRINTING PRESS

SUMMARY OF THE INVENTION

The present invention is directed to the adjustment of rollers in a printing press and, more particularly, it is concerned with the adjustment of one roller into contact with two separate rollers.

In printing presses, particularly in letter press and offset printing machines, a great number of rollers cooperate to provide a thin, sufficiently homogeneous color film for application on the printing plate. Usually, the ink flows over hard surfaced rollers, generally metallic rollers, which alternate with soft surfaced rollers, generally rubber-coated rollers, where the hard surfaced rollers are spaced apart at a fixed center distance, while the soft surfaced rollers are forced into contact with a pair of hard surfaced rollers and the distances from the center of the soft surfaced rollers to the centers of the hard surfaced rollers must be variable. The contacting engagement is effected under a selected pressure so that the soft surfaced rollers are flattened and a contact strip is formed at the area of contact. In making contact, the pressure of force applied must not be too high, since it would impair the printing quality and would generate unnecessary heat, however, the pressure also must not be too low, otherwise the contact friction will not be sufficient to set the soft rollers in rotation and to assure that unavoidable faulty concentric running does not result in periodic loss of roller contact.

These conditions can be met with a simple arrangement as long as the rollers to be placed in contact are true cylindrical surfaces. However, plate cylinders in letter presses and offset printing machines have longitudinal grooves in their surface for clamping the printing plates in position. These longitudinal grooves provide an unprinted strip on the printed product which is known as the white edge.

When the soft surface inking roller travels over the longitudinal grooves of the plate cylinder, it has the tendency to be displaced into the groove and then be forced out again by the following edge of the printing plate. Such a result must be avoided under any circumstances. It is important that the position of the soft surfaced roller be rigid and very accurately adjustable. Where the contact strip formed between the rollers has a width of 10 mm, for example, the amount of flattening is only about 0.2 mm and it requires great skill on the part of the printer to make such an adjustment, and in particular because the work involved is dirty, due to the presence of the ink. Another problem results because the soft surfaced roller expands more than the hard surfaced or metallic rollers and the machine frame and due to this the amount of flattening increases as the roller heat increases with extended printing time. Further, during operation the plate cylinder must be shifted relative to the printing cylinder and, therefore, its position relative to the inking rollers changes and the amount of flattening also varies. Under such circumstances it is necessary for the printer to adjust the inking rollers constantly. In the past this was not done or was only done haphazardly by manually operated micrometer screws.

Therefore, it is the primary object of the present invention to provide part or complete automatic adjustment of the rollers where the problems experienced in the past are overcome and accurate adjustment of the rollers is assured.

In accordance with the present invention, the adjustment of the rollers is subdivided into separate adjustment steps which are carried out in a series arrangement. Initially, a first roller is automatically positioned against a second roller under a given load and the center distance between the two rollers is fixed. Next, a stop surface on the first roller is moved into contact with a corresponding stop on the third roller while the center distance between the first two rollers is maintained the same as originally set.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
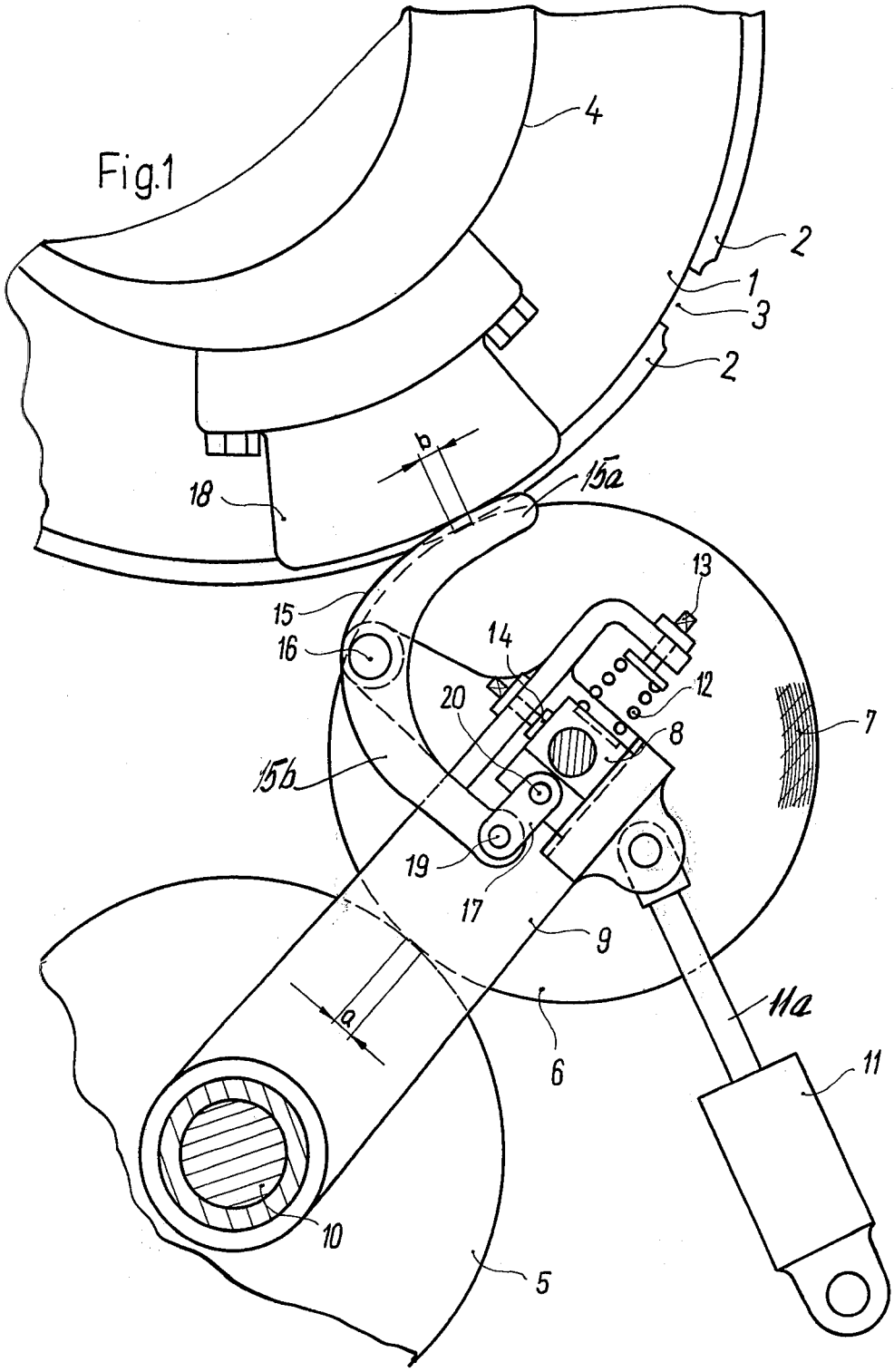
FIG. 1 is a side view of the adjustment arrangement for a plurality of rollers in accordance with the present invention.

In FIG. 1, a plate cylinder 1 has clamped-on printing plates 2 separated from one another by a longitudinal groove 3 on the surface of the cylinder. The plate cylinder 1 is mounted in an eccentric bearing bush 4 which can be turned so that the position of the plate cylinder relative to the printing cylinder, not shown, can be varied.

In addition to the relatively hard surfaced plate cylinder 1, another hard surfaced roller 5 is spaced from the plate cylinder and is rotatably mounted on an axle 10 which is held in a stationary position in the machine frame, not shown. An inking roller 6 with a soft surface or coat 7 must be adjusted relative to both the plate cylinder 1 and the roller 5 and, as shown in FIG. 1, a contact strip *a* must be provided between the soft roller 6 and the hard roller 5 with a second contact strip *b* between the soft roller and the plate cylinder.

The soft surfaced roller 6 is rotatably mounted in a bearing 8 which is mounted in the form of a slide in a lever 9. The lever 9 is pivoted on the axle 10 of the roller 5 and the slide or bearing 8 can be moved in the lever for varying the distance between the center of the roller 6 and the surface of the roller 5. A working cylinder 11, located at a fixed position, is connected over a reciprocating rod 11*a* to the end of the lever 9 spaced outwardly from the stationary axle 10. In the lever, a spring 12 or any other biasing means, adjustable by a screw 13, biases the bearing 8 toward the hard surfaced roller 5 to provide the desired contact between the two rollers 5, 6. The combination of the force of the spring 12 and the weight of the roller afford a flattening of the surface of the roller 6 so that a contact strip of the width *a* is provided between the two rollers. After the bearing 8 has been displaced through the lever into position with the desired contact established between the two rollers, a fixing device 14 mounted on the lever, usually a pressing device, is actuated for holding the bearing 8 in position so that the relative center distance between the rollers does not change.

To provide contact between the roller 6 and the plate cylinder 1, a stop 15 is pivotally connected by a pin 16 to the lever 9. The stop 15 is an angular-shaped or two-arm lever member 15*a*, 15*b* with the lever arm 15*a* arranged to contact a stop member 18 on the plate cylinder 1. As the rod 11*a* is extended outwardly from the working cylinder 11, the lever 9 pivots about the stationary axle 10 until a portion of the lever arm 15*a* on the stop 15 contacts the stop member 18, which contact coincides with the contact between the roller and the printing plates 2 on the plate cylinder 1. By exerting a certain excess force, the working cylinder forces the roller 6 against the printing plate 2 so that a contact strip having a width *b* is established between the roller and the plate. The ratio of the lever arms 15*a*, 15*b* can be selected so that the width of the contact strip *b* is achieved when the stop 15 and the stop member 18 are in contact. The end of the lever arm 15*b* spaced from the pin 16 is connected by a pin 19 to a link member 17 and the other end of the link member is secured by an eccentric bolt 20 to the bearing 8. The distance between the bearing 8 and the pin 19 can be varied by selectively rotating the eccentric bolt 20 and such variation effects a change in the width of the contact strip *b*. However, changing the dimension between the bearing 8 and the pin 19 does not influence the width of the contact strip *a* which depends only on the load applied by the weight of the roller 6 and the force of the spring 12.

Figure 2:
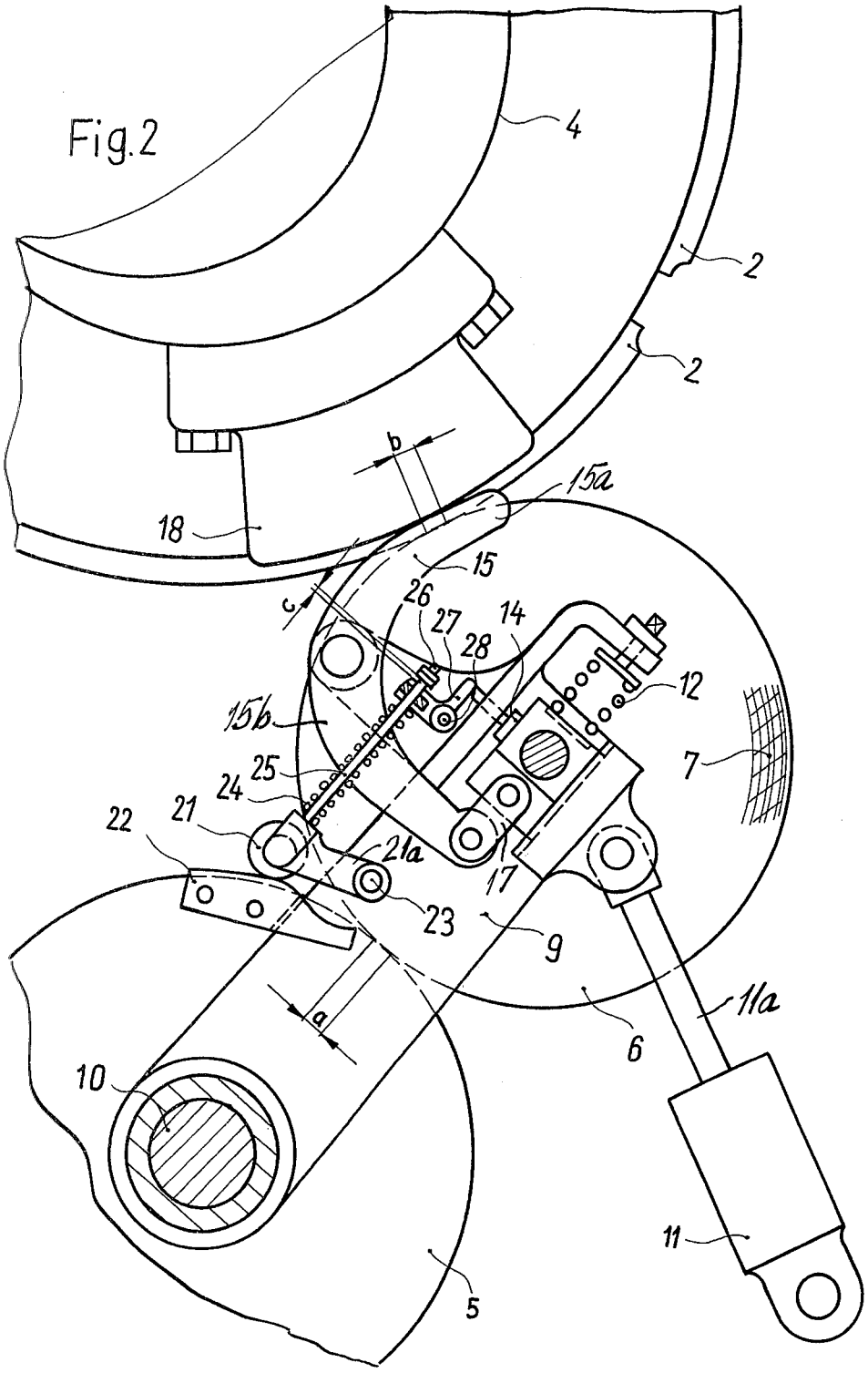
FIG. 2 is a view similar to FIG. 1, however, providing an additional automatic feature of the adjustment.

If the diameter of the roller 6 changes, because of heat, or if the eccentric bearing bush 4 of the plate cylinder 1 is changed for printing reasons, the position of roller 6 can be adapted to the new conditions by retracting the rod 11*a* into working cylinder 11, briefly loosening fixing device 14 by hand, and again extending the rod 11*a* to achieve the desired contact. This operation can be performed, if necessary, without stopping the printing machine, because the inking mechanism usually involves more than one inking roller and the inking is ensured by the other inking roller or rollers during the brief period of contact interruption as one roller after the other is maneuvered into position. To avoid any manual adjustment of the fixing device 14, the arrangement in FIG. 2 can be used in providing an adjustment between the roller 6 and printing plate 2. As the roller 6 is moved toward the printing plate 2 by means of the working cylinder 11 and its rod 11*a*, a roller 21 contacts a cam surface 22 positioned on the machine frame, not shown. The roller 21 is positioned at one end of a lever 21*a* while the other end of the lever is connected by a pin 23 to the lever 9. Further, a tie rod 25 extends outwardly from the end of the lever 21*a*, at which the roller is located, along the lever 9 to a point with its opposite end adjacent the fixing device 14. A stop 26 is located on the outer end of the rod 25 and an angled lever 27 is connected by a pin 28 to the lever 9 and extends about the rod 25 just inwardly of the stop 26. Further, a spring 24 is wound around the rod 25 and extends between the lever 21*a* and the lever 27. The spring 24 biases the lever 27 against the fixing device 14 so that the fixing device is locked and holds the bearing 8 in place. As the fixing device is locked, stop 26 is lifted upwardly from the lever 27 by an amount *c*, note FIG. 2, so that seizing is made ineffective, for example, by heat, even in longitudinal variations.

Figure 3:
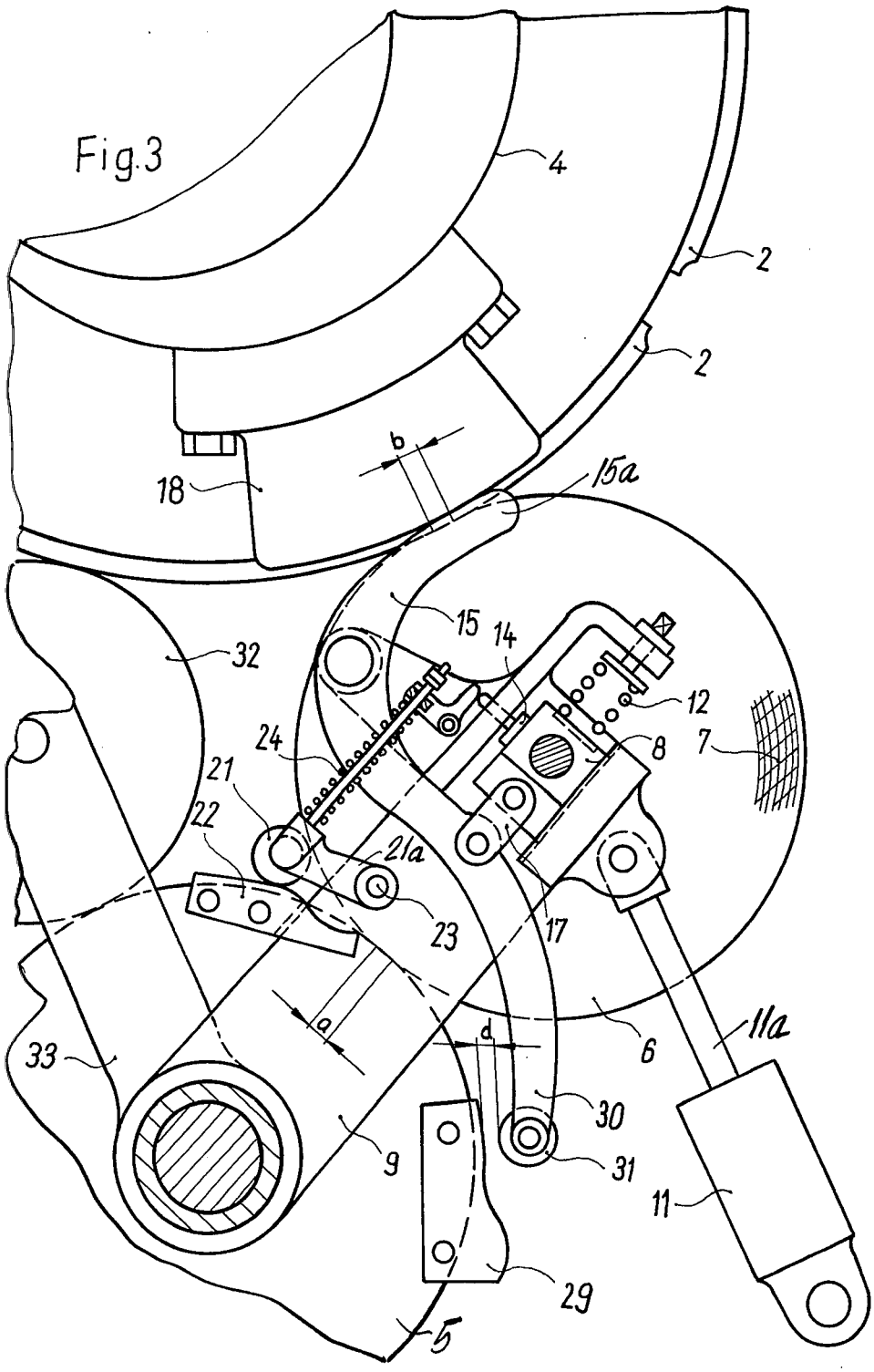
FIG. 3 is a view, similar to FIGS. 1 and 2, illustrating an arrangement for completely automatic adjustment in accordance with the present invention.
Figure 4:
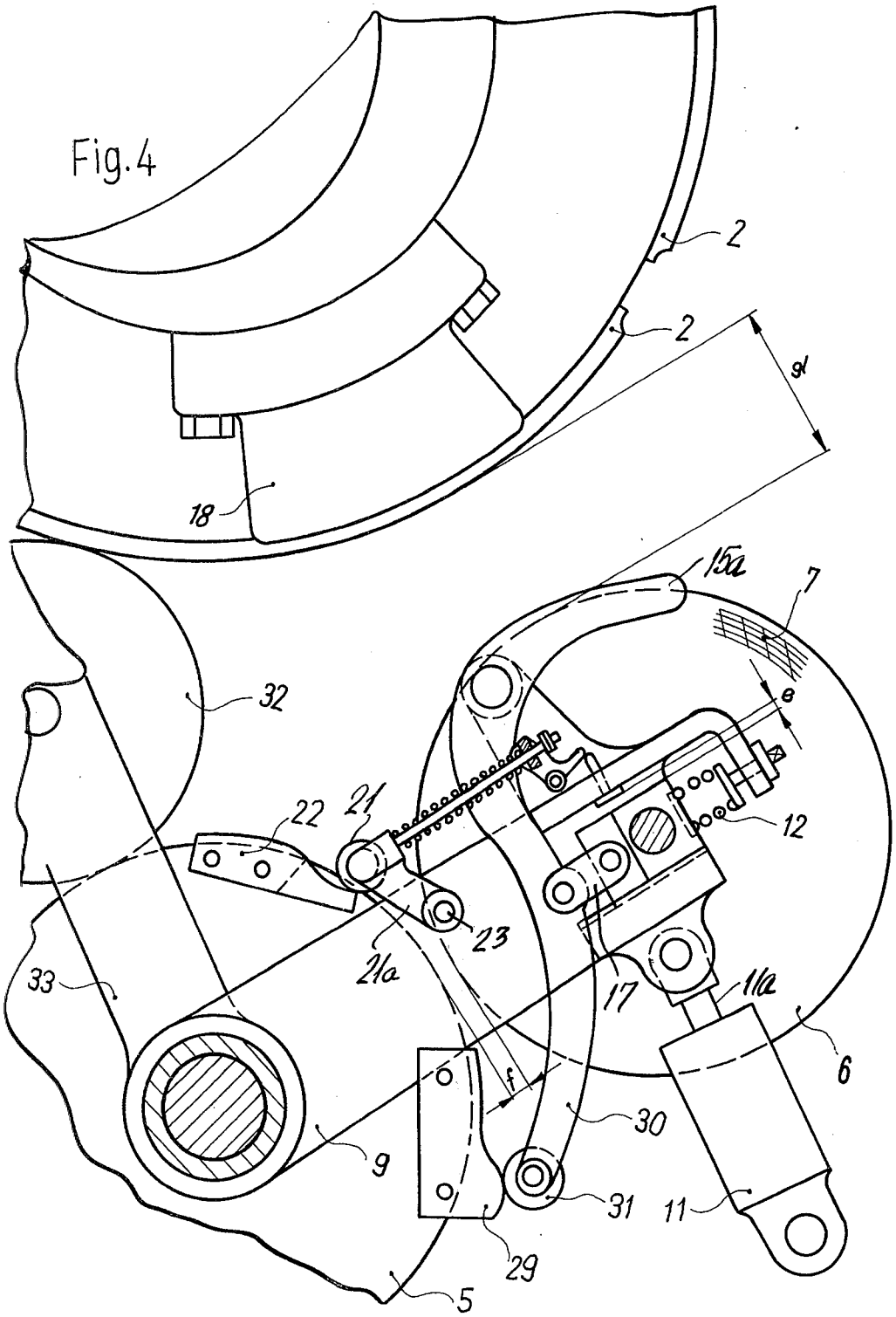
FIG. 4 is a view of the roller arrangement shown in FIG. 3 with the roller surfaces in spaced relationship.
Figure 5:
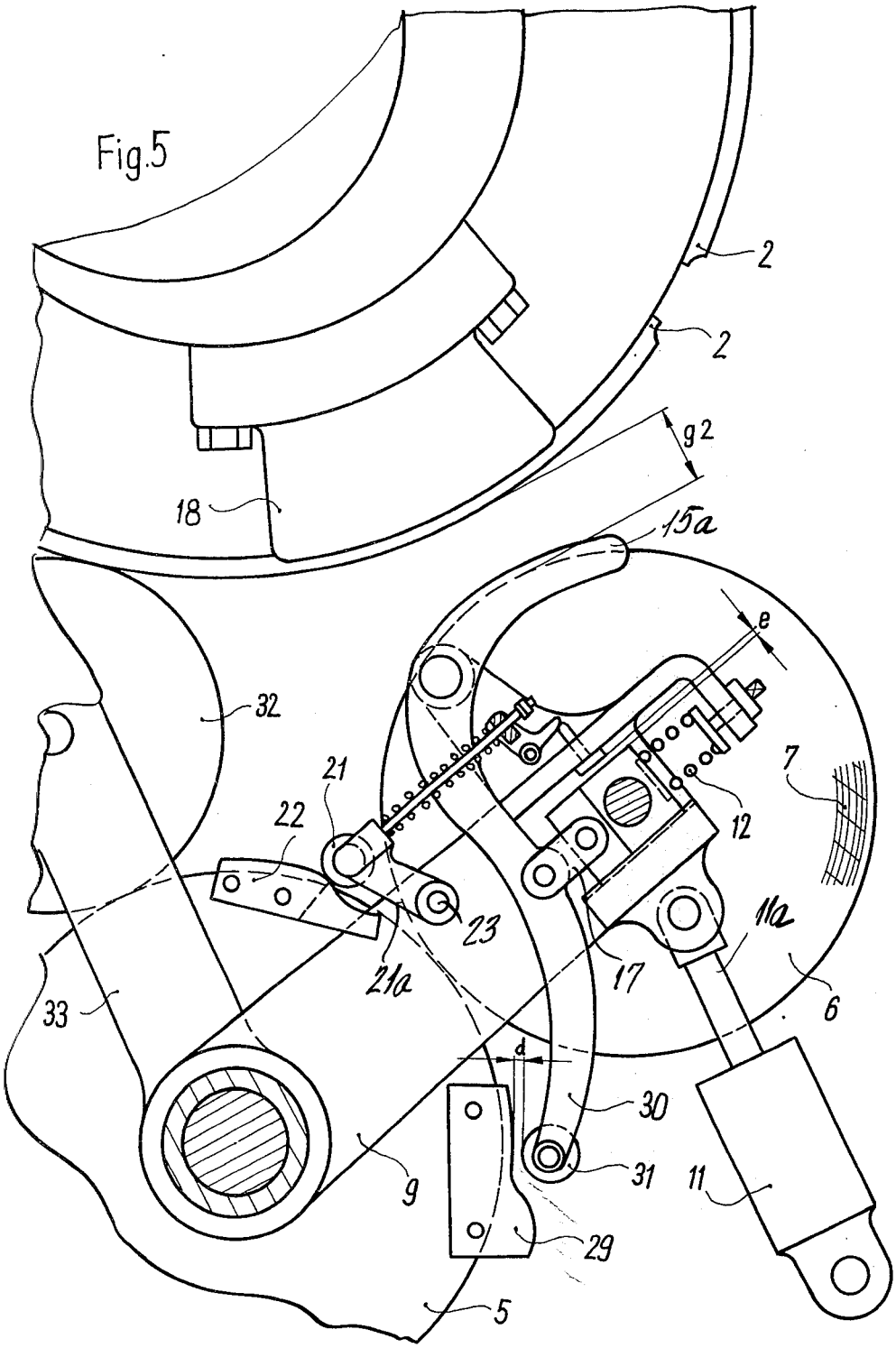
FIG. 5 is a view of the roller arrangement shown in FIG. 3 with two of the rollers adjusted into contacting relationship.

If roller 6 requires adjustment, it is only necessary to retract the rod 11*a* briefly at which time the roller 21 moves over the cam surface 22. Cam 22 is shaped so that during retraction of the rod 11*a* the movement of the roller 21 causes the stop 26 to rest on the lever 27, releasing the lever and, in turn, unlocking the fixing device 14. With the fixing device free of the bearing 8, the spring 12 can move roller 6 into an adjusted position corresponding to the changed conditions. At the same time, the position of the stop 15 is also corrected. When the working cylinder 11 again extends the rod 11*a*, roller 6 is fixed in a new position relative to roller 5 and, when stop 15 strikes against stop member 18, the roller 6 is in adjusted contact with the printing plate 2 in accordance with the changed conditions. At times it is also desirable to lift the roller 6 from roller 5. To afford such a lifting action, as illustrated in FIGS. 3, 4 and 5, a cam surface 29 is secured on the machine frame, not shown. Further, the arm 15*b* of the stop 15 is extended by another lever arm 30 beyond the point of pin connection of the link member 17 to the stop, and a roller 31 is positioned on the end of the lever arm 30 adjacent the cam surface 29. If, after the fixing device 14 has been unlocked, a further retraction of the rod 11*a* takes place, then the roller 31 rides up on cam surface 29 and displaces the roller 6 over the link member 17 and the bearing 8 from contact with the roller 5, this displacing action takes place against the action of the spring 12.

In FIG. 3, the roller 6 is shown in contact with both the roller 5 and the printing plate 2 on the plate cylinder 1 while in FIG. 4 the roller 6 is shown displaced from contact. In moving the roller 6 into contact starting from the position shown in FIG. 4, the roller 6 has been lifted from the roller 5 by an amount f due to the contact of the roller 31 with the cam surface 29. Further, with the rod 11*a* completely retracted into the working cylinder 11, the roller 6 is lifted from the printing plate 2 by an amount *g*1. As the rod is extended from the working cylinder, the position of the rollers as shown in FIG. 5 is attained. Initially, the roller lifts off the cam surface 29 by an amount *d* and the roller 6, under the action of the spring 12 biasing the bearing 8 toward the stationary axle 10, produces the contact strip *a* between the rollers 5 and 6, as shown in FIG. 3. At this point, as shown in FIG. 5, the roller 6 is spaced at a distance *g*2 from printing plate 2. As the extension of the rod continues, the position of the roller 6 illustrated in FIG. 3 is reached. In the position shown in FIG. 3, the fixing device secures the bearing 8 due to the position of the roller 21 on the cam surface 22. With the fixing device locked, the contact strip *a* is set and will not change and the contact strip *b* is established when the stop 15 moves into contact with the stop piece 18. With the working cylinder maintaining the position of the roller 6 relative to the printing plate 2, the positions established are held until the rod 11*a* is again retracted into the working cylinder.

No more than one inking roller 32 can cooperate with roller 5, since lever 33, which positions inking roller 32 relative to roller 5, is arranged about the same center as the lever 9, though it is independent of it. If additional inking rollers are to cooperate with printing plate 2, the number of rollers 5 must be increased, which increase is readily understandable and need not be represented.

While specific embodiments of the invention have been shown and described in detail to illustrate the application of the inventive principles, it will be understood that the invention may be embodied otherwise without departing from such principles.

What is claimed is:

1. A device for adjusting the positions of rollers in a printing machine comprising a first roller, a stationary axle rotatably mounting said first roller, a second roller spaced from said first roller, a movably displaceable third roller arranged to contact said first and second rollers, first means connected to said stationary axle and supporting said third roller and fixably positioning it relative to said first roller so that a fixed distance is maintained between the axle of said third roller and the axle of said first roller and a fixed area or strip of contact is established between said first and third rollers, said first means includes a stop surface connected to said third roller and spaced from the strip of contact between said first and second rollers, said second roller having a stop thereon, second means operatively connected to said first means for movably displacing said first means about said stationary axle for placing said stop surface connected to said third roller into contact with said stop on said second roller and for establishing a strip of contact between said second and third rollers while maintaining the distance between the axle of said third roller and the axle of said first roller, said first means comprises a first lever pivotally mounted on said stationary axle and extending outwardly therefrom, a bearing rotatably mounting said third roller and slidably mounted on said first lever for movement toward and away from said stationary axle, a biasing member positioned on said first lever for forcing said bearing and third roller toward said first roller, a fixing device on said first lever for fixably positioning said bearing and said third roller relative to said first roller, said stop surface on said first means comprises an angle-shaped second lever pivotally connected intermediate its ends to said third roller, said second lever having a first arm and a second arm each extending from the point of pivotal connection to said third roller and angularly disposed relative to the other, said first arm forms said stop surface for contact with said second roller, a link, a pin connecting said link at one end to said second arm of said second lever at a position spaced from the pivotal connection of said second lever to said third roller, and an eccentric bolt connecting the other end of said link to said bearing for said third roller so that the distance between said bearing and the pin connection of said link to said second arm can be varied by rotating said eccentric bolt.

2. A device, as set forth in claim 1, wherein said second means comprises a working cylinder stationarily mounted and including a rod arranged in and extending outwardly from said working cylinder for movement inwardly and outwardly relative to said working cylinder, the end of said rod extending outwardly from said working cylinder being secured to said first lever and said rod being secured to said first lever at a position spaced outwardly from said stationary axle.

3. A device, as set forth in claim 2, wherein a first cam is adapted to be mounted on the frame of the printing machine, third means connected to said third roller and disposed in operative engagement with said fixing device, said third means arranged to contact said first cam so that as said third roller is placed in contact with said first roller said third means are displaced for locking said fixing device into position for fixing said bearing.

4. A device, as set forth in claim 3, wherein said third means comprises a third lever pivotally connected to said first lever, a roller mounted on said third lever in spaced relationship from the point of pivotal connection of said third lever to said first lever, said roller arranged to contact said first cam, a rod attached to said third lever and extending therefrom in the direction of said fixing means, a stop member positioned on the end of said rod spaced from said third lever, a fourth lever pivotally mounted on said third lever and having a pair of angularly disposed arms with one of said arms located adjacent said rod and positioned between said stop member and the end of said rod attached to said third lever, a spring encircling said rod and extending between the end of said rod attached to said third lever and said arm on said fourth lever adjacent said rod for pivoting said fourth lever about its point of pivotal connection to said first lever, the other of said arms of said fourth lever arranged to contact said fixing device as set fourth lever is pivotally biased by said spring so that said fixing device fixes the position of said bearing for said third roller, and said stop member arranged to contact said one of said arms of said fourth lever and to pivot said fourth lever against the biasing action of said spring for releasing said fixing device from locking action with said bearing for said third roller.

5. A device, as set forth in claim 4, wherein a second cam is adapted to be mounted on the frame of said printing machine, an extension connected to and extending outwardly from the end of said second arm of said second lever and connected to said link, a roller mounted on the end of said extension at its opposite end from said second arm, said roller on said extension arranged to travel over said second cam and to lift said third roller by means of said link member and bearing out of contact with said first roller.

6. A method for adjusting a soft surfaced roller into contact with a pair of spaced hard surfaced rollers with the axes of the three rollers disposed in substantially parallel relation, comprising the steps of pivotally supporting the soft surfaced roller about the axis of one of the hard surfaced rollers and linearly biasing the soft surfaced roller in its pivotally supported position into contact with the one of the hard surfaced rollers and establishing under a predetermined load a two-dimensional strip of contact therebetween, locating a stop surface on the soft surfaced roller in spaced relation to a stop on the other of the hard surfaced rollers, fixing the relative position between the soft surfaced roller and the one of the hard surfaced rollers to maintain the contact strip under a predetermined load therebetween, automatically pivoting the soft surfaced roller through the arc of a circle with the axis of the one of the hard surfaced rollers as its center toward the other of the hard surfaced rollers for moving the stop surface on the soft surfaced roller into contact with the stop on the other of the hard surfaced rollers while maintaining unchanged the dimension between the axes of the soft surfaced roller and the one of the hard surfaced rollers, establishing a two-dimensional strip of contact under a predetermined load between the soft surfaced roller and the other hard surfaced roller and fixing the relative positions between the soft surfaced roller and the other hard surfaced roller for maintaining the contacting relationship therebetween.

7. A device for adjusting the positions of rollers in a printing machine comprising a first roller, a stationary axle rotatably mounting said first roller, a second roller having its axis in parallel relation with and spaced from said first roller, a movably displaceable third roller arranged to contact said first and second rollers, a movable axle rotatably mounting said third roller, first means pivotally connected to said stationary axle and supporting said axle of said third roller and fixably positioning the axle of said third roller in the radial direction relative to said axle of said first roller so that a fixed distance is maintained between the axle of said third roller and the axle of said first roller and a fixed area or strip of contact under a predetermined load is established between said first and third rollers, said first means includes a stop surface connected to said third roller and spaced from the strip of contact between said first and third rollers, said second roller having a stop thereon, second means operatively connected to said first means for automatically movably displacing said axle of said third roller in a circular arc centered about said stationary axle for placing said stop surface connected to said third roller into contact with said stop on said second roller and for establishing a strip of contact under a predetermined load between said second and third rollers while maintaining the fixed distance between the axle of said third roller and the axle of said first roller and the predetermined load of said third roller on said first roller, said first means comprises a first lever pivotally mounted on said stationary axle and extending radially outwardly therefrom, a bearing rotatably mounting the axle of said third roller, said bearing slidably mounted on said first lever for movement in the radial direction of said first roller toward and away from said stationary axle, a biasing member positioned on said first lever for forcing said bearing and third roller toward said first roller and for establishing a predetermined load of said third roller on said first roller, and a fixing device on said first lever for fixably positioning said bearing and said third roller under its predetermined load relative to said first roller.

* * * * *